United States Patent [19]

Nakao et al.

[11] 4,117,665

[45] Oct. 3, 1978

[54] MAGNETIC SHIELD PLATE MOUNTING STRUCTURE FOR AN ELECTRONIC TIMEPIECE

[75] Inventors: Hideyuki Nakao; Yasuhiro Kasai; Yukio Ikehata; Shigeyuki Masuda; Nobuo Obara; Isamu Nishida, all of Tokyo, Japan

[73] Assignee: Kabushiki Kaisha Daini Seikosha, Japan

[21] Appl. No.: 753,848

[22] Filed: Dec. 23, 1976

[30] Foreign Application Priority Data

Dec. 26, 1975 [JP] Japan ..... 51-178990[U]

[51] Int. Cl.[2] ..... G04B 43/00

[52] U.S. Cl. ..... 58/106.5; 58/88 R

[58] Field of Search ..... 58/88 R, 106.5, 104

[56] References Cited

U.S. PATENT DOCUMENTS

| | | | |
|---|---|---|---|
| 4,033,111 | 7/1977 | Matsuura | 58/106.5 |
| 4,044,542 | 8/1977 | Burke | 58/88 R |

*Primary Examiner*—Robert K. Schaefer

*Assistant Examiner*—Leonard W. Pojunas, Jr.

*Attorney, Agent, or Firm*—Robert E. Burns; Emmanuel J. Lobato; Bruce L. Adams

[57] ABSTRACT

In an electronic timepiece, a baseplate having a pair of opposed major surfaces, a magnetic shield plate disposed in continuous contact with one of the major surfaces and a stator disposed on the other of the major surfaces. A pin is inserted through the magnetic shield plate, baseplate and stator and includes a head portion bearing against the magnetic shield plate, and is engaged by a screw having a head bearing against the stator for fixing the shield plate, baseplate and stator between the head portion and the screw head. The shield plate includes an inwardly sloped aperture for receiving the head portion of the pin, and the head portion has a tapered peripheral surface complementary to the inwardly sloped surface of the aperture. The head portion is thinner than the shield plate and does not protrude beyond a surface of the shield plate, and because the shield plate is in continuous contact with the base plate it is not deformed by the head portion of the pin bearing thereagainst.

2 Claims, 6 Drawing Figures

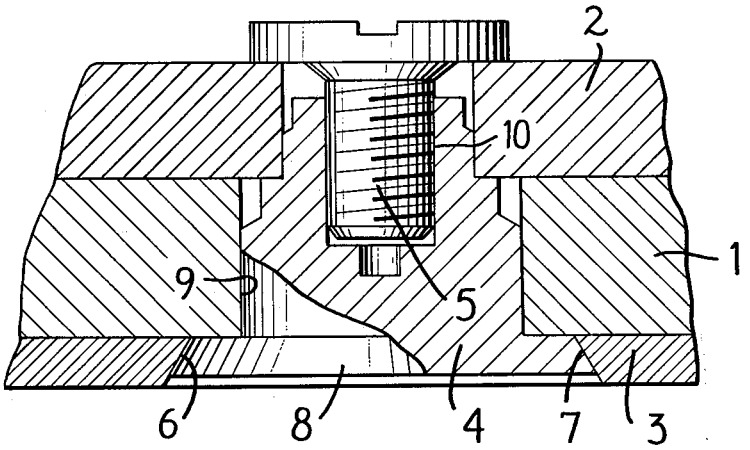
2
10
1
9
5
6
8
4
7
3

MAGNETIC SHIELD PLATE MOUNTING STRUCTURE FOR AN ELECTRONIC TIMEPIECE

BACKGROUND OF THE INVENTION

This invention relates to mounting structure of a magnetic shield plate of a converter for an electronic timepiece.

Conventionally, in an electronic timepiece a magnetic shield plate is mounted on a base plate, a bridge, a rear case or the like in order to shield magnetism from the outside which may have an influence on motor rotation of the electronic timepiece. As the result, a magnetically shielded timepiece is thick and large.

SUMMARY OF THE INVENTION

The present invention aims to eliminate the above mentioned difficulties and insufficiencies. The object of the present invention is to provide an electronic timepiece which is magnetically shielded, thin and which has small external dimensions.

BRIEF DESCRIPTION OF THE DRAWING

The sale FIGURE is a partial cross sectional and broken view of the present invention.

DESCRIPTION OF THE PREFERRED EMBODIMENT

According to the drawing, reference numeral 1 is a base plate of an electronic timepiece movement, 2 is a stator or a magnetic core of a coil block of a motor (broadly, a member of magnetic material) of a motor mounted on one side of the base plate 1, and 3 is a magnetic shield plate mounted on the other side of the base plate 1, 4 Screw pin 4 fixes the base plate 1, the stator 2 and the magnetic sealed plate 3 together in conjunction with the screw 5. An inclined hole or inwardly 6 sloped aperture the outer side of which has a larger diameter and the inner side of which has the smaller diameter, is made through the magnetic shield plate 3 while the magnetic shield plate 3 is mounted on a first major surface of the base plate 1 in continuous contact therewith. At one end of the screw pin 4 is provided a step portion or head portion 8 having an inclined face or tapered peripheral surface portion 7 which corresponds to and is complementary with the inclined hole 6 and at the other end of which is provided with an internal axial threaded bore 10 which engages the screw 5. Additionally a hole or bore 9 is made through the base plate 1 to drive and fix the screw pin 4.

First, the magnetic shield plate 3 is placed on one major surface of the base plate 1, and the inclined face 7 of the head portion 8 of the screw pin 4 is seated on to the inclined face of the aperture 6 by inserting the screw pin 4 into the aperture 6 from the outside of the magnetic sealed plate 3, and then the screw pin 4 is driven into the bore 9 of the base plate to fix the magnetic sealed plate to the major surface of the base plate 1.

The screw pin 4 has a smaller diameter end portion remote from the head portion 8. This end portion fits closely within the hole through the member 2 of magnetic material and fixes the position of the member 2 on the other major surface of the baseplate 1. The magnetic shield plate 3, baseplate 1 and member 2 are held together between the head portion 8 of the pin 4 and the head of the screw 10. Because the magnetic shield plate 3 is in continuous contact with the first major surface of the baseplate 1, the magnetic shield plate is not deformed by the head portion 8 of the pin 4 bearing thereagainst.

According to the present invention, the inclined face of the head portion of the screw pin is set in the inclined hole made through the magnetic shield plate and is thinner than the shield plate of so that the head portion does not protrude beyond the surface of the magnetic shield plate. Therefore the outer face of the head portion of the screw pin does not protrude outside of the magnetic shield plate and is accommodated inside of the aperture as shown in the drawing.

The magnetic shield plate can be mounted on the base plate by the screw pin which mounts the stator and doesn't require other mounting members in particular. Moreover, since the head portion of the screw pin is accommodated within the aperture through the magnetic shield plate and doesn't protrude outside, it is not necessary to make the timepiece body member or the rear case mounted on the base plate particularly thick in order to mount the magnetic shield plate. Therefore a thin, smart watch which is magnetically shielded and which requires fewer parts than usual can be realized.

We claim:

1. In a timepiece: a baseplate having a pair of opposed major surfaces and having a bore extending therethrough between said pair of major surfaces; a magnetic shield plate disposed on one of said major surfaces and continuously in contact with said one major surface, said magnetic shield plate having an aperture therethrough aligned with the bore through said baseplate, and the aperture through said magnetic shield plate having a diameter greater than that of the bore and having a periphery defined by a sloped peripheral surface sloped inwardly of the aperture in a direction toward said baseplate; a member of magnetic material disposed on the other of said major surfaces and having a hole therethrough aligned with the aperture through said magnetic shield plate and the bore through said baseplate, and the hole having a diameter smaller than the diameter of the bore through said baseplate; a pin inserted through the aperture through said magnetic shield plate, through the bore through said baseplate and through the hole through said member of magnetic material, said pin including a head portion having a diameter equal to the diameter of the aperture through said shield plate and having a tapered peripheral surface portion complementary to said inwardly sloped peripheral surface of the aperture through said shield plate with said tapered peripheral surface portion of said head portion seated on said inwardly sloped peripheral surface of the aperture through said shield plate, and said head portion having a thickness less than the thickness of said shield plate so that said head portion of said pin does not protrude above a surface of said shield plate, said pin further including an end portion remote from said head portion and having a diameter effective to permit said end portion of said pin to fit closely within the hole through said member of magnetic material, and said pin further including an intermediate body portion between said head portion and said end portion of said pin and dimensioned to fit closely within the bore through said baseplate; and means having a head greater in diameter than the hole through said member of magnetic material for engaging said pin for fixing said magnetic shield plate, said baseplate and said member of magnetic material together, with said magnetic shield plate continuously in contact with said one major surface of said baseplate to remain undeformed by said head portion of said pin bearing against said shield plate.

2. In a timepiece according to claim 1, wherein said means having a head comprises: a screw including a threaded shank portion and said head on one end of said shank portion; and wherein said pin includes an axaial threaded bore open at the end of said pin remote from said head portion of said pin, said threaded shank portion of said screw being inserted in and engaged with the threaded bore of said pin with the screw head against said element of magnetic material for fixing said shield plate, said baseplate and said element of magnetic material together between said head portion of said pin and said screw head.

* * * * *